United States Patent [19]

Mallory

[11] 4,050,111

[45] Sept. 27, 1977

[54] WINDOW CLEANING DEVICE

[75] Inventor: George Raeburn Mallory, Blenheim, Canada

[73] Assignee: Mallory Hardware Products Limited, Blenheim, Canada

[21] Appl. No.: 664,571

[22] Filed: Mar. 8, 1976

[30] Foreign Application Priority Data

Mar. 2, 1976 Canada ..... 246987

[51] Int. Cl.[2] ..... A47L 1/08

[52] U.S. Cl. ..... 15/232; 15/244 R; 15/209 B

[58] Field of Search ..... 15/116 A, 110 A, 121, 15/232, 244 R, 244 A, 209 B; 401/25-27

[56] References Cited

U.S. PATENT DOCUMENTS

| | | | |
|---|---|---|---|
| 2,946,073 | 7/1960 | Vosbikian et al. | 15/244 R X |
| 3,229,317 | 1/1966 | Linenfelser | 15/121 |
| 3,724,017 | 4/1973 | Mallory | 15/121 |
| 3,897,603 | 8/1975 | Brennenstuhl | 15/244 R |

FOREIGN PATENT DOCUMENTS

| | | | |
|---|---|---|---|
| 584,387 | 10/1959 | Canada | 15/121 |
| 2,051,378 | 4/1972 | Germany | 15/244 R |

*Primary Examiner*—Daniel Blum
*Attorney, Agent, or Firm*—Fetherstonhaugh & Co.

[57] ABSTRACT

A window cleaning device consisting of a sponge, a head for supporting the sponge and a stiffener web for stiffening the sponge and securing the sponge with respect to the head. The stiffener has a pair of ridges which are located within a channel formed in the head in a face-to-face relationship with respect to flanges at the outer edge of the channel formed in the head so as to compress the sponge between the ridges and the flanges of the head to firmly secure the sponge within the head.

2 Claims, 2 Drawing Figures

WINDOW CLEANING DEVICE

FIELD OF INVENTION

This invention relates to window cleaning devices. In particular, this invention relates to an improvement in the window cleaning device of the type having a sponge mounted in a channel formed in a supporting head structure.

PRIOR ART

A window cleaning device of the type to which the present invention relates is described in my earlier U.S. Pat. No. 3,724,017, dated Apr. 3, 1973. In window cleaners of this type, difficulty has been experienced in securely clamping the sponge within the head. The cleaning action is such that it tends to pull the sponge out of the channel in which it is clamped. This difficulty is experienced in window cleaning units of the type which employ a sponge member and in units in which the sponge member has a net-like cover extending around the wiping surface.

In fact, it has been found that the addition of a net-like cover to the standard sponge further increases the difficulty of securely clamping the sponge and the net in the channel formed in the head for this purpose. The net-like cover acts as a scraper which engages surface irregularities on the window surface. While this action provides an effective scraping of the surface to remove the irregularities, a considerable force may be applied to the netting tending to pull it out of the channel in which it is mounted.

The present invention seeks to overcome the difficulties of the prior art described above and provides an assembly in which the sponge is more securely mounted with respect to the head.

While the present invention is applicable to window cleaning devices which employ a sponge without a net-like cover, it has been found that the invention is particularly well suited for use in a window cleaner in which the sponge member is covered by a net-like cover as the securing features of the present invention serve to anchor the net-like member as well as the sponge.

SUMMARY OF INVENTION

According to one aspect of the present invention, there is provided in a window cleaning device of the type described the improvement of the stiffener comprising an elongated body of substantially rigid material having a pair of ridges projecting outwardly from opposite sides of the body to a combined width which is greater than the width of the narrow passage which opens into the channel formed in the head within which the mounting portion of the assembled cover and sponge is located. A spacer web projects from one side of said ridges and a stiffener web projects from the other side thereof. The stiffener is located within a slit formed in the sponge with the ridges disposed within the channel which is formed in the head inwardly of the flanges which form the narrow passage in the channel to cooperate with the flanges to secure the sponge and net between the inner edges of the flanges and the ridges.

Figure 1:
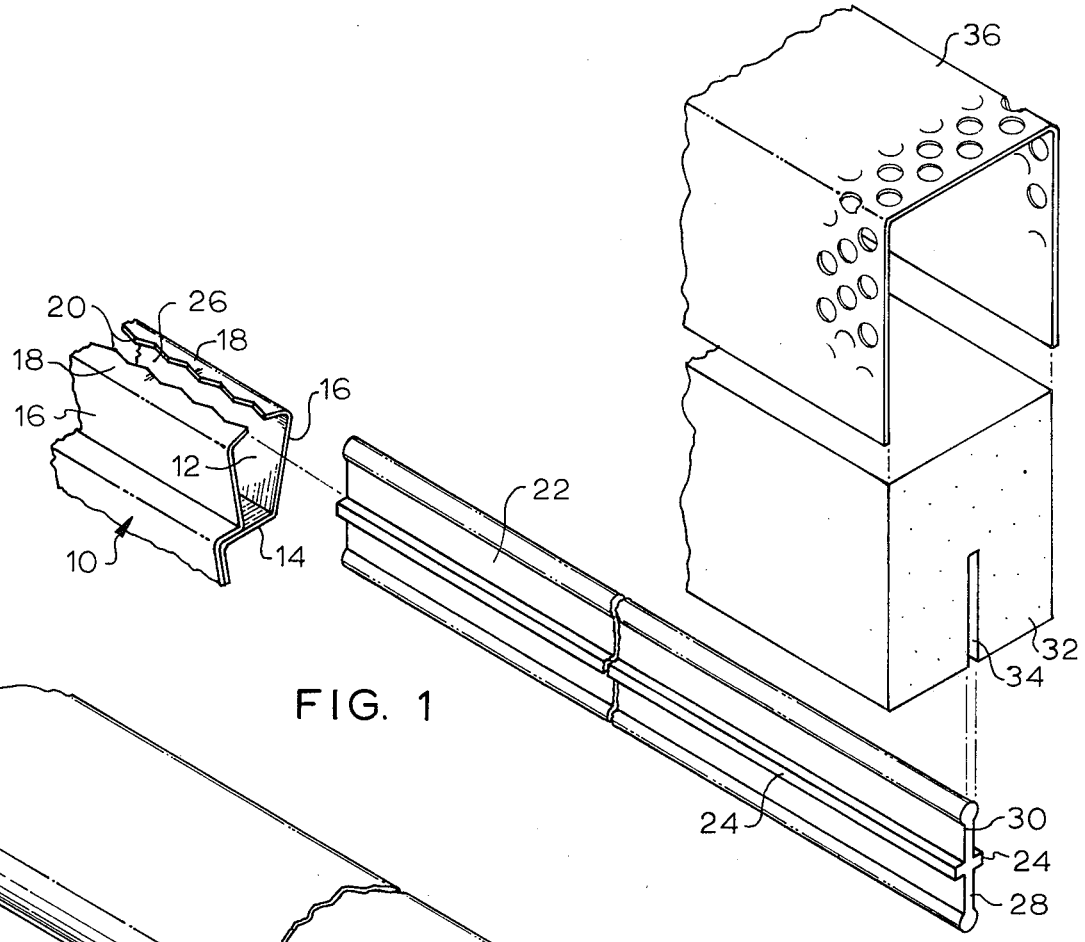
Figure 2:
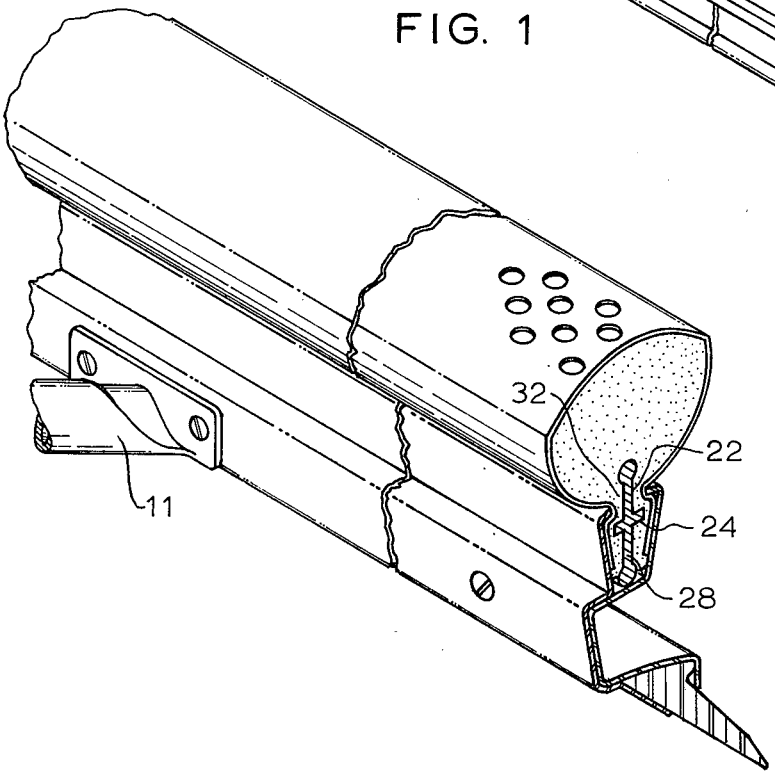

The invention will be more clearly understood after reference to the following detailed specification read in conjunction with the drawings, wherein FIG. 1 is a pictorial exploded view of a stiffener and a portion of the head in which the stiffener is mounted; and FIG. 2 is a pictorial view similar to FIG. 1 with parts in section illustrating the manner in which the sponge, net and stiffener are mounted in the head.

With reference to FIG. 1 of the drawings, the reference numeral 10 refers generally to a portion of the head of the window cleaner device of the type described in my prior U.S. Pat. No. 3,724,017. The head 10 is formed to provide the channel 12 which is bounded by an inner wall 14, a pair of oppositely disposed side walls 16 and a pair of flanges 18 which extend inwardly from the outer ends of the side walls 16. The flanges 18 have a serrated inner edge 20. The head 10 is mounted on a handle 11 of the type described in U.S. Pat. No. 3,724,017.

The stiffener 22 consists of a body of substantially rigid material, such as a semi-rigid plastic material or the like and has a pair of shoulders 24 projecting outwardly from opposite sides thereof. The shoulders 24 have a combined width which is greater than the width of the passage 26 which is formed between the inner edges 20 of the flanges 18. The stiffener 22 also has a spacer web 28 projecting from one side of the shoulders 24 and a stiffener web 30 projecting from the opposite side thereof. The spacer web 28 has a length which is less than the depth of the channel 12 so that when the stiffener 22 is mounted in the head with the outer edge of the spacer web 28 resting on the inner wall 14 of the channel, the shoulders 24 will be located inwardly of the flanges 18 in a close face-to-face relationship therewith. The stiffening flange 30 has a length sufficient to extend outwardly through the passage 26 into the body of a sponge 32.

The sponge 32 is formed with a slit 34 extending inwardly from one face thereof into which the stiffener member is inserted. A web of net-like material 36 extends over the outer side and top face of the sponge in a conventional manner.

The assembled sponge cover and stiffener are located in the head between the walls 16 of the channel and the head is assembled to the configuration shown in FIG. 2 wherein, as previously described, a portion of the sponge 32 and its associated cover 36 is located within the channel 12 and firmly secured therein by being clamped between the flanges 18 and the shoulders 24 of the stiffener member. It has been found that by reason of the fact that the shoulders 24 are maintained in a fixed position within the channel by the spacer web 28, the flanges 18 cooperate with the shoulders 24 to effectively clamp and secure the sponge and cover assembly therebetween to an extent sufficient to prevent pulling out of the cover 36 and sponge 32 in use.

It will be understood that while the preferred embodiment describes a structure which includes a net-like cover around the sponge, the improved stiffener member of the present invention may be employed to advantage in a window cleaner unit in which the sponge does not have a net-like cover extending thereabout. In this embodiment the structure would be exactly the same as that illustrated in the drawings with the exception that the net-like cover member 36 would be omitted.

From the foregoing it will be apparent that the present invention provides a simple and inexpensive structure for overcoming the difficulties previously described with respect to the piror art.

The embodiments of the invention in which an exclusive property or privilege is claimed are defined as follows:

1. In a window cleaning device of the type consisting of a handle, a head mounted on the handle, the head having a longitudinally elongated channel formed therein, the channel having an inner wall and oppositely disposed side walls, a flange on each of its oppositely disposed side walls projecting inwardly therefrom to form a narrow passage therebetween, a longitudinally elongated sponge having a longitudinally extending mounting portion and a longitudinally extending wiping portion, the mounting portion being mounted within said channel to secure the sponge with respect to the head, the sponge having a slit formed in the mounting portion and extending into the wiping portion thereof to receive a stiffener, the improvement of a stiffener member formed from an elongated body of stiff material comprising a. a pair of shoulders extending longitudinally of the body and projecting outwardly from the opposite sides of the body to divide the body into a spacer web on one side of the shoulders and a stiffener web on the other side thereof, b. the shoulders having a combined width which is greater than the width of said narrow passage, c. said stiffener member being located within said slit of said sponge with said shoulder portions thereof disposed within said channel in a face-to-face relationship with said flanges, d. said spacer web projecting from said shoulders into engagement with the inner wall of said channel to prevent movement of the shoulders inwardly with respect to the channel such that the sponge is tightly clamped between the shoulders and the flanges, said stiffener web projecting outwardly from said channel to stiffen the wiping portions of the sponge, the stiffener being movable in a direction outwardly of the channel upon distortion of the sponge during use.

2. In a window cleaning device of the type consisting of a handle, a head mounted on the handle, the head having a longitudinally elongated channel formed therein, the channel having an inner wall and oppositely disposed side walls, a flange on each of its oppositely disposed side walls projecting inwardly therefrom to form a narrow passage therebetween, a longitudinally elongated sponge having a longitudinally extending mounting portion and a longitudinally extending wiping portion, the mounting portion being mounted within said channel to secure the sponge with respect to the head, a net-like cover extending over the wiping surface of the wiping portion of the sponge and having opposite ends thereof interposed between the side walls of the channel and the mounting portion of the sponge, the sponge having a slit formed in the mounting portion and extending into the wiping portion thereof to receive a stiffener, the improvement of an elongated stiffener member formed from a body of stiff material comprising a. a pair of shoulders extending longitudinally of the body and projecting outwardly from the opposite sides of the body to divide the body into a spacer web on one side of the shoulders and a stiffener web on the other side thereof, b. the shoulders having a combined width which is greater than the width of said narrow passage, c. said stiffener member being located within said slit of said sponge with said shoulder portions thereof disposed within said channel in a face-to-face relationship with said flanges, d. said spacer web projecting from said shoulders into engagement with the inner wall of said channel to prevent movement of the shoulders inwardly with respect to the channel such that the sponge and cover are tightly clamped between the shoulders and the flanges, said stiffener web projecting outwardly from said channel to stiffen the wiping portions of the sponge, the stiffener being movable in a direction outwardly of the channel upon distortion of the sponge during use.

* * * * *